United States Patent [19]

Morishita et al.

[11] Patent Number: 4,591,480

[45] Date of Patent: May 27, 1986

[54] METHOD FOR SEALING POROUS METALS

[75] Inventors: Tsuyoshi Morishita; Sigemi Osaki; Noriyuki Sakai, all of Hiroshima; Yasuhumi Kawado, Iwakuni, all of Japan

[73] Assignee: Mazda Motor Corporation, Hiroshima, Japan

[21] Appl. No.: 702,571

[22] Filed: Feb. 19, 1985

[30] Foreign Application Priority Data

Feb. 24, 1984 [JP] Japan ..... 59-33750

[51] Int. Cl.[4] ..... B22F 7/00

[52] U.S. Cl. ..... 419/9; 419/8; 419/31; 419/32; 419/36; 419/38; 419/47; 419/54; 419/55; 419/57; 419/58; 419/60; 427/376.1; 427/383.7; 428/550; 428/682; 428/704

[58] Field of Search ..... 419/8, 9, 47, 31, 32, 419/36, 38, 54, 55, 57, 58, 60; 427/376.1, 383.7; 428/550, 682, 704

[56] References Cited

U.S. PATENT DOCUMENTS 4,000,980 1/1977 Marishita ..... 419/10 X 4,223,434 9/1980 Wang et al. ..... 419/5 X

FOREIGN PATENT DOCUMENTS 56-35704 4/1981 Japan .

OTHER PUBLICATIONS

Metal Surface Technique, vol. 32, No. 8.

*Primary Examiner*—Stephen J. Lechert, Jr.

*Attorney, Agent, or Firm*—Fleit, Jacobson, Cohn & Price

[57] ABSTRACT

A method for sealing porous metals, which comprises applying powder of a eutectic alloy containing an element having a good diffusibility in a porous metal or powder of a mixture of metals capable of forming the eutectic alloy, to the surface of a porous metal member and heating the surface applied with the powder at a temperature higher than the eutectic temperature of the eutectic alloy to thereby cause the molten eutectic alloy to intrude into pores from the surface of the porous metal member, whereby the melting point of the molten alloy in the pores is promptly increased by diffusion of the element in the porous metal member to solidify the molten metal in the pores, sealing only pores present in the vicinity of the surface of the porous metal member.

7 Claims, 3 Drawing Figures

(X 100)

(X 100)

METHOD FOR SEALING POROUS METALS

BACKGROUND OF THE INVENTION

1. Field of the Invention

The present invention relates to a method for sealing porous metals.

2. Description of Prior Art

Ordinarily, a sintered metal contains pores in an amount of 5 to 30% by volume. This sintered metal having pores impregnated with a lubricating oil is utilized as a lubricatless bearing. Such sintered metals are very often plated in order to improve the corrosion resistance or abrasion resistance, or for a decorative purpose. When such a plating is carried out, plating solution permeates into pores in the plating step and such plating solution cannot sufficiently be removed even if washing is performed after the plating. As the results, the metals are corroded at the peripheries of pores to reduce the corrosion resistance. In case of an iron type sintered alloy, carburization, carbonitriding or soft-nitriding is very often carried out so as to improve the abrasion resistance or strength. This treatment, for example, carburizing quenching, should be effected in a depth of about 1 mm from the surface to harden the surface, and it is necessary to retain the interior toughness. If the treatment such as carburization is performed on a porous metal member without effecting a sealing treatment in advance, however, hardening is advanced to a depth exceeding 1 mm, with the result that the interior toughness is drastically reduced and the metal member cannot be put into practical use.

Therefore, sealing treatments are usually carried out before such treatments as plating, carburization, carbonitriding and soft-nitriding are conducted. Examples of such sealing treatments are disclosed by Japanese Patent Application Laid-Open Specification No. 56-35704 and Japanese Publication "Metal Surface Technique", Vol. 32, No. 8, 1981, published by the Metal Surface Technique Association. The sealing treatments are carried out by one of the following steps.

(1) A porous metal member is impregnated with paraffin or a polymeric material.

(2) A porous metal member is impregnated with a water glass material.

(3) The topmost surface of a porous metal member is subjected to a mechanical plastic processing to effect sealing.

The method (1) is carried out as a preliminary treatment for the plating operation. In this method, paraffin or a polymeric material is stuck even to a portion other than surface pores, that is, a substrate portion, and therefore, a step of removing the paraffin or polymeric material becomes necessary. Furthermore, the method (1) is defective in that since the difference of the thermal expansion coefficient between the material to be treated and the impregnation treatment agent is large, complete sealing is hardly attained.

The method (2) is utilized as a preliminary treatment when carburization, carbonitriding or soft-nitriding is performed in the heated state. The method (2), however, is defective in that the impregnation material is left after the sealing treatment and the characteristics of the porous member, such as the light weight and porosity, are degraded.

According to the method (3), the plastic flow is caused on the surface of a porous material by a roll or coining mold to crush pores. However, the shape of the material to be treated is limited to a specific shape and only a material in which the plastic flow is readily caused can be treated. Accordingly, this method is not a general method.

As another method, there has been known a method in which an oxide film is formed on inner surfaces of effective pores extended to the interior by an oxidation treatment to effect sealing. In this method, however, since even the substrate on the topmost surface is oxidized to form an oxide film, a preliminary treatment such as a shot blasting treatment or a barrel treatment becomes further necessary for removing this oxide film.

Moreover, there is known a method in which an iron type sintered alloy is impregnated with copper or a copper alloy to improve the strength. There also is known a method for improving the abrasion resistance of a sintered alloy to be used as a valve seat of an engine by impregnating the sintered alloy under a pressure with a low-melting-point metal or alloy such as lead or a lead alloy by utilizing an autoclave or the like.

It is apparent that when a sealing treatment is carried out as a preliminary treatment for carburization, carbnitriding or soft-nitriding of a porous metal member such as an iron type sintered alloy, it is sufficient if only effective pores present in the vicinity of the topmost surface of the porous metal member are sealed. However, if the sealing treatment is performed by the above-mentioned melt impregnation method or compression impregnation method, the treating agent such as a molten metal or alloy does not remain only in the portion close to the surface but permeates into the deep portion through pores, and therefore, it is necessary to use a large quantity of the treating agent. Furthermore, if the treating agent permeates even into the deep portion, the pores are closed and the characteristic property of the porous member, that is, the porosity, is degraded.

OBJECT OF THE INVENTION

It is a primary object of the present invention to provide a method for sealing a porous metal member in which only pores present in the vicinity of the topmost surface of the porous metal member are sealed.

SUMMARY OF THE INVENTION

We noted the characteristics of a eutectic alloy and found that the above object can be attained by using a eutectic alloy as a sealing material for a porous metal member. We have now completed the present invention based on this finding.

More specifically, in accordance with the present invention, there is provided a method for sealing porous metals, which comprises applying powder of a eutectic alloy containing an element having a good diffusibility in a porous metal or powder of a mixture of metals capable of forming said eutectic alloy to a surface of a porous metal member and heating the surface applied with the powder at a temperature higher than the eutectic temperature of said eutectic alloy.

The porous metal member to be treated in the present invention includes a sintered alloy member, a foamed metal member and a green compact. A most typical example is an iron type metal member.

The eutectic alloy to be used as a sealing material in the present invention comprises as a constituent element an element excellent in the diffusibility in the porous metal to be treated. A mixture of metals capable of forming a eutectic alloy as mentioned above under heating may be used as the eutective alloy in the present invention. As preferred examples of the eutective alloy to be used for treating an iron type porous metal member, there can be mentioned Fe-P, Fe-P-C, Fe-Mo-C and Fe-B-C.

In the present invention, not only an alloy or mixture composed solely of eutectic components but also an alloy or mixture comprising eutectic components and other metals can be used as the sealing material.

Various methods can be utilized for sticking a powdery alloy or a powder of a mixture of metals as the sealing material to the surface of a porous metal member. For example, there may be adopted a method in which camphor in an amount of 0.5 to 4% by weight based on the alloy powder or metal mixture powder is dissolved in acetone or the like and wet-kneaded with the alloy powder or metal mixture powder to form a paste and the porous metal member is immersed in the paste or the paste is coated on the portion to be sealed of the porous metal member. Furthermore, there may be adopted a method in which an acrylic resin is incorporated into the alloy powder or metal mixture powder in an amount of 1 to 7% by weight based on the alloy powder or metal mixture powder, a solvent such as toluene is added to the mixture if necessary, the mixture is kneaded, if necessary, under heating and roll-molded into a sheet having an appropriate thickness (about 2 to about 10 mm) and the sheet is bonded to the surface of the porous metal member directly or through an adhesive having the same composition as that of the acrylic resin.

In the case where an iron type alloy is used as a sliding material, if the sliding surface pressure is low, the presence of pores is preferred because the pores act as oil reservoirs. However, if the sliding surface pressure is increased, the lubricating oil is pressed into the pores and the contact area of the sliding surface is reduced by the pore area, and since the surface pressure supporting the base metal is increased, the presence of pores adversely affects the sliding characteristics and promotes the abrasion of the sliding material. Therefore, it is desirable to improve the abrasion resistance by sealing these pores by using an abrasion-resistant eutectic alloy, for example, the above-mentioned eutectic alloy such as Fe-P, Fe-P-C, Fe-Mo-C or Fe-B-C.

After the alloy powder or metal mixture powder has been applied to the surface of the porous metal, the powder-applied surface is heated at a temperature of the eutectic temperature of the eutectic component in a non-oxidizing atmosphere. As the non-oxidizing atmosphere, there can be used inert atmospheres such as nitrogen and argon, reducing atmospheres such as hydrogen, and vacuum. It is preferred that the temperature-elevating rate be lower than 40° C./min. When a powder molded body containing an acrylic resin as a binder is used, if the temperature is elevated after maintenance at a temperature of 150° to 380° C. for more than 5 minutes, a sufficiently high bonding force is held between the powder molded body and the surface of the porous metal even during the course of from 380° C. to the eutectic temperature, and even if the powder molded body is bonded to an inclined surface or a lower surface, peeling or falling is not caused and good results can be obtained.

When the temperature is elevated to the eutectic temperature, the eutectic component is molten, intrudes into pores and falls in contact with the porous metal. The element of the eutectic component having an excellent diffusibility in the porous metal is promptly diffused in the porous metal. Accordingly, in the portion close to the surface of the porous metal, the eutectic relation in the molten eutectic alloy breaks and the melting point of the molten alloy is increased, and therefore, the alloy is promptly solidified to close the pores, with the result that intrusion of the molten eutectic alloy in a deeper portion of the porous metal member is inhibitied. Thus, only the portion close to the surface of the porous metal member is completely sealed but pores present separately from the surface are not sealed but left as they are.

DESCRIPTIONS OF THE PREFERRED EMBODIMENT

This sealing mechanism will now be described with reference to an embodiment in which an iron type sintered alloy is used as the porous metal and an alloy comprising 2.4% by weight of P, 9.8% by weight of Mo, 2.4% by weight of Cr, 3.9% by weight of C, 0.6% by weight of Si and 0.4% by weight of Mn with the balance being Fe is used as the sealing material. All of "%" in the following description are by weight.

This alloy comprises three eutectic portions, that is, Fe-P(6.9%)-C(2.4%) (eutectic temperature of 950° C.), Fe-P(9.2%)-C(0.8%) (eutectic temperature of 1005° C.) and Fe-Mo(15%)-C(4.3%) (eutectic temperature of 1070° C.). Accordingly, if this alloy powder is heated in a non-oxidizing atmosphere, the eutectic portions are molten at 950° C., 1005° C. and 1070° C., respectively. Each of these melts has a good wetting property with the iron type sintered alloy in a non-oxidizing atmosphere and intrudes into pores by the capillary phenomenon. The reason why the melts are solidified and intrusion into pores present in a deeper portion is inhibitied will now be described in detail with reference to an A-B binary phase diagram of FIG. 1.

Figure 1:
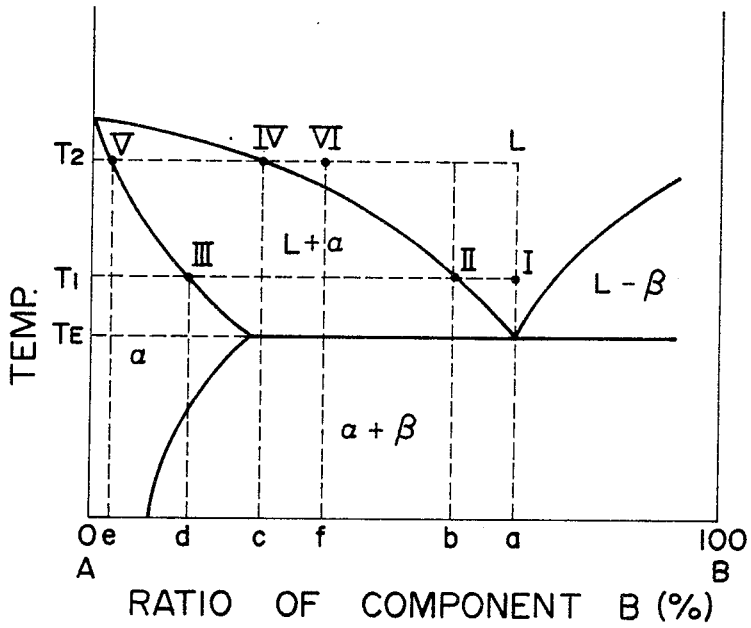
FIG. 1 is a phase diagram of a binary eutectic alloy A-B.

Referring to FIG. 1, the proportion of the component B molten by heating at a temperature $T_1$ higher than the eutectic temperature $T_E$ is a% (I). If this melt intrudes into pores of the iron type sintered alloy by the capillary phenomenon, the component B having a higher diffusibility is promptly diffused into the substrate contiguous to the pores, while iron of the substrate is diffused in the melt. Accordingly, the proportion of the component B in the melt is reduced from a% to b% (II). If the proportion of the component B is reduced below b%, the melt is changed to a semi-molten state ($L+\alpha$) and the solid phase $\alpha$ is precipitated in the liquid phase. The mutual diffusion is further advanced and the proportion of the component B is further reduced, and if the proportion of the component B is reduced below d% (III), the melt is completely solidified to form a solid phase $\alpha$. As the result, the pores are closed and the melt is not allowed to intrude into the pores any more.

In case of the above-mentioned alloy, when the temperature exceeds 950° C., the eutectic portion comprising P and C as the eutectic components is molten and intrudes into pores. As this piont, P and C having a high diffusibility are diffused into the substrate contiguous to the pores and Fe in the substrate is diffused into the melt. As the result, the composition of the melt deviates from the eutectic composition and the melt is solidified. When the temperature then exceeds 1005° C., a similar phenomenon should take place. However, at this point, since the majority of P has already been diffused into Fe of the substrate, the portion where P is present in such a large amount as 9.2% is greatly reduced and therefore, crystallization is reduced in the liquid phase having the eutectic temperature of 1005° C. When the temperature is further elevated and exceeds 1070° C., the eutectic components of Fe-Mo(15%)-C(4.3%) are molten and intrude into the pores, and Mo and C having a high diffusibility are diffused in the substrate contiguous to the pores and Fe in the substrate is diffused in the melt, with the result that the composition of the melt deviates from the eutectic composition and the melt is solidified to close the pores.

Pores of an iron type porous member can be closed by using an alloy containing an iron type eutectic alloy component as the sealing material in the above-mentioned manner.

The sealed depth of pores, that is, the intrusion depth of the melt, can be controlled by appropriately selecting the composition of the sealing material and the heating temperature. This point will now be described with reference to FIG. 1.

Referring to FIG. 1, when an alloy of composition I (the proportion of the component B is a%) is heated at a temperature $T_1$ higher than the eutectic temperature $T_E$, the alloy is molten to form a liquid phase L. When this melt intrudes into pores of an iron type sintered alloy, the proportion of the component B in the melt is gradually reduced, as pointed out hereinbefore, and when the proportion of the component B is reduced below b%, a solid phase $\alpha$ is precipitated and when the porportion of the component B is reduced below d%, the melt is completely solidified. However, even in the case where the same alloy of composition I is used, if the heating temperature is adjusted to $T_2$ which is higher than $T_1$, even when the proportion of the component B is reduced below b%, the solid phase $\alpha$ is not precipitated. When the proportion of the component B is reduced below c% (composition IV) at the temperature $T_2$, the solid phase $\alpha$ is precipitated for the first time. Accordingly, even when alloys having the same composition are used, if the melting temperature is high precipitation of the solid phase is delayed and hence, the melt can be present in the form of a liquid for a long time. Therefore, the intrusion depth of the melt into the pores is increased as compared with the intrusion depth attained at a lower melting temperature.

However, even if the same melting temperature is adopted, when an alloy of composition IV having a lower proportion of the component B is used, the time during which the melt can be present in the liquid form is shorter than in case of an alloy of composition I having a higher proportion of the component B. Accordingly, in this case, the intrusion depth of the melt is decreased.

As is apparent from the foregoing description, in order to increase the intrusion depth of the melt, the heating temperature may be elevated, or an alloy having a larger proportion of an element excellent in the diffusibility may be used. In contrast, in order to decrease the intrusion depth of the melt, the heating temperature may be lowered or an alloy having a small proportion of an element excellent in the diffusibility may be used.

As described above, the intrusion depth of the melt, that is, the sealing depth of pores, can be controlled by appropriately selecting the composition of the alloy and the heating temperature. Moreover, in order to further reduce the intrusion depth, the composition of the alloy and the heating temperature are selected so that the treatment is carried out in the semi-molten state as close to the solid phase line as possible (for example, an alloy of composition IV is treated at the temperature $T_1$). However, if the semi-molten state is too close to the solid phase line, the amount of the solid phase is increased and residues are left on the surface of the iron type sintered alloy, and hence, the step of shaving out these residues becomes necessary. Accordingly, it is generally preferred that the composition of the alloy and the heating temperature be selected so that the amount of the liquid phase is at least 30% by volume based on the solid phase.

EFFECT OF THE INVENTION

According to the present invention, only pores present in the vicinity of the surface of a porous metal member can be sealed, and the sealing depth of pores can be controlled.

EXAMPLE

Figure 2:
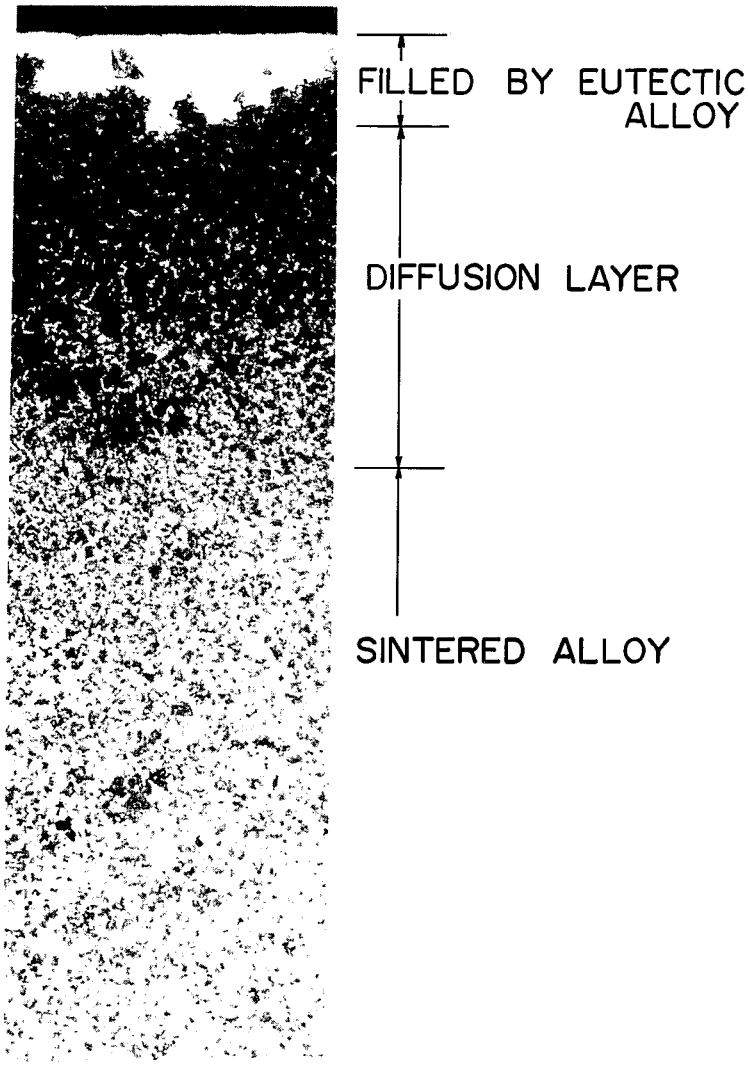
FIG. 2 is a microscopic photograph of a sectional texture of the surface portion of the sintered body sealed according to the method of the present invention.

Toluene was added to 93% of an alloy powder comprising 2.4% of P, 9.5% of Mo, 2.4% of Cr, 3.9% of C and 0.6% of Si with the balance being Fe and having a grain size of 200 mesh or smaller and 7% of an acrylic resin, and the mixture was kneaded and rolled to form a sheet having a thickness of 0.5 to 0.6 mm. This sheet was cut into a size of 12 mm×30 mm and the cut sheet was bonded to a sintered body comprising 0.45% of C with the balance being Fe and having a density of 6.65 g/cm$^2$ (having a size of 12 mm×30 mm×6 mm). The sheet-applied sintered body was heated to 300° C. in a hydrogen gas atmosphere at a temperature-elevating rate of 10° C./min, and the sintered body was maintained at 300° C. for 1 hour. Then, the sintered body was heated to 1080° C. at a temperature-elevating rate of 15° C./min and maintained at this temperature for 15 minutes, followed by gradual cooling. A microscope photograph of the section of the texture in the vicinity of the sealed surface after corrosion by a 3% alcohol solution of nitric acid is shown in FIG. 2. From FIG. 2, it is seen that pores present in the depth of up to about 0.15 mm from the surface were sealed but interior pores present in a deeper portion were not sealed.

Figure 3:
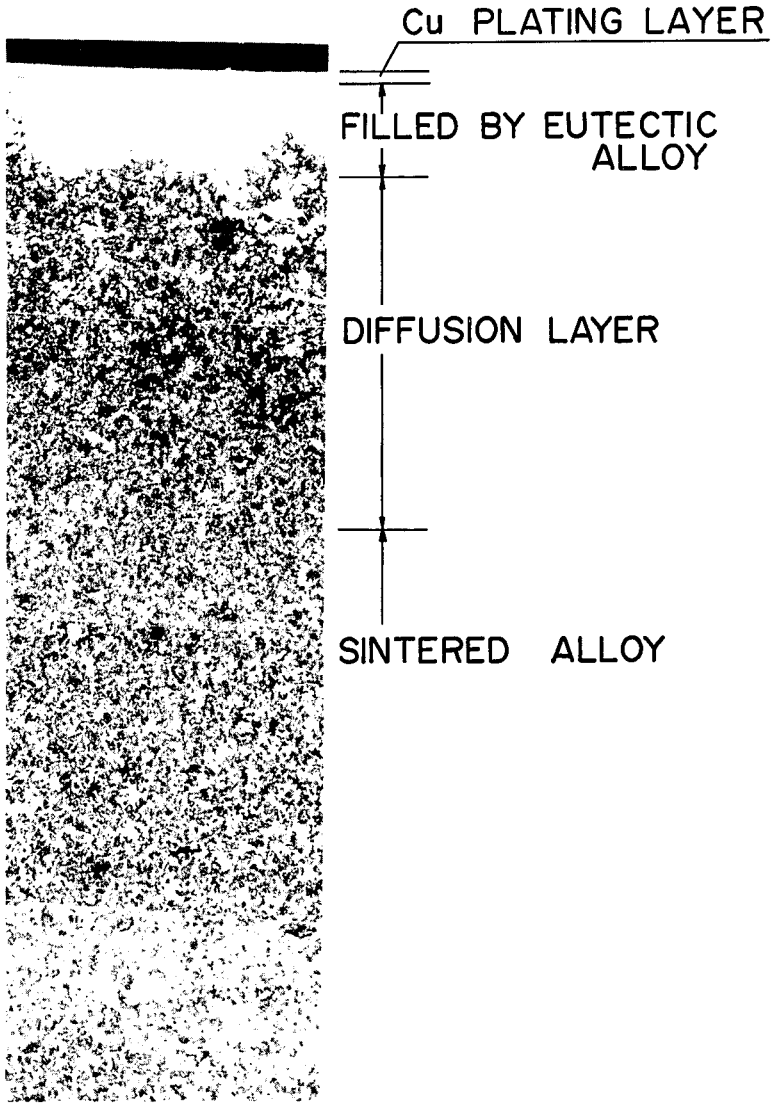
FIG. 3 is a microscopic photograph of a sectional texture of the surface portion of a sintered body obtained by plating the sintered body shown in FIG. 2 with copper.

The so-sealed sintered body was plated with copper and corroded by a 3% alcohol solution of nitric acid. A microscope photograph of the section of the texture is shown in FIG. 3.

We claim:

1. A method for sealing porous metals comprised of an iron-based sintered alloy, said method comprising applying powder of a eutectic alloy of one of Fe-P, Fe-P-C, Fe-Mo-C and Fe-B-C type, to the surface of said porous metal member and heating said surface applied with the powder to a temperature higher than the eutectic temperature of said eutectic alloy to allow said molten eutectic alloy to intrude into pores from the surface of the porous metal member so that the melting point of said molten alloy in the pores is promptly increased by diffusion of said element in said porous metal member to solidify said molten metal in the pores, sealing only pores present in the vicinity of the surface of the porous metal member.

2. A method in accordance with claim 1 in which said powder is mixed with 0.5 to 4.0 weight % of camphor and kneaded with an addition of acetone before it is applied to the surface of the porous metal member.

3. A method in accordance with claim 1 in which said powder is mixed with 1 to 7 weight % of acrylic resin and formed into a sheet before it is applied to the surface of the porous metal member.

4. A method in accordance with claim 1 in which the heating is carried out in a non-oxidating atmosphere.

5. A method in accordance with claim 6 in which the non-oxidating atmosphere is one of inactive gas atmospheres, a reducing gas atmosphere and vacuum.

6. A method in accordance with claim 1 in which said powder is applied to the surface by being mixed with an acrylic binder and a preheating step is carried out prior to the heating step, said preheating step comprising heating the surface applied with said powder to 150° to 380° C. and maintaining at the temperature for more than 5 minutes.

7. A method in accordance with claim 1 in which quantity of B, P or Mo in accordance with the temperature at which the surface applied with the powder so that sealing depths can be adjusted.

* * * * *